US008408136B1

(12) United States Patent
Lee

(10) Patent No.: US 8,408,136 B1
(45) Date of Patent: Apr. 2, 2013

(54) NITINOL RING MARMON CLAMP

(75) Inventor: Robert S. Lee, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 1360 days.

(21) Appl. No.: 12/100,667

(22) Filed: Apr. 10, 2008

(51) Int. Cl.
*F42B 15/36* (2006.01)

(52) U.S. Cl. ..... 102/377

(58) Field of Classification Search ..... 285/381.1, 285/381.2; 102/377
See application file for complete search history.

(56) References Cited

U.S. PATENT DOCUMENTS

| | | | | |
|---|---|---|---|---|
| 863,887 | A * | 8/1907 | Stuttle | 285/373 |
| 865,056 | A * | 9/1907 | Palmer | 138/99 |
| 4,198,081 | A * | 4/1980 | Harrison et al. | 285/381.2 |
| 4,758,285 | A | 7/1988 | Hodgson et al. | |
| 4,773,680 | A * | 9/1988 | Krumme | 285/381.2 |
| 4,832,382 | A * | 5/1989 | Kapgan | 285/369 |
| 5,279,022 | A | 1/1994 | Giacomel | |
| 5,338,070 | A * | 8/1994 | Horikawa et al. | 285/148.23 |
| 5,687,995 | A * | 11/1997 | Mori et al. | 285/381.2 |
| 5,810,881 | A | 9/1998 | Hoski et al. | |
| 6,637,110 | B2 * | 10/2003 | Jee | 29/890.031 |
| 6,746,461 | B2 | 6/2004 | Fry | |
| 7,175,344 | B2 | 2/2007 | D'Ouince et al. | |

FOREIGN PATENT DOCUMENTS

FR 2658284 A1 * 8/1991

OTHER PUBLICATIONS

Rudolphi, T. J. et al., "Stress and Deformation Analysis of a Tube and Coupling Device", *Plenum Publishing Corporation*, 233 Spring St., New York, NY 10013 Conference, San Diego, California Jul. 8, 1984 , 1151-1158.

* cited by examiner

*Primary Examiner* — Michael Carone
*Assistant Examiner* — Reginald Tillman, Jr.
(74) *Attorney, Agent, or Firm* — Withrow & Terranova, PLLC

(57) ABSTRACT

A missile, a method of making a missile, and a clamp for making a missile, comprising providing two sections of a missile and joining the two sections with a clamp comprising a plurality of pieces for engaging a circumference of the two sections, each of the pieces comprising at least two grooves extending substantially the length of the piece, and at least two Nitinol rings placed one in each of the at least two grooves.

14 Claims, 2 Drawing Sheets

NITINOL RING MARMON CLAMP

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field):

The present invention relates to methods and apparatuses for joining sections of a missile.

2. Description of Related Art:

Current missile assembly practices 10 typically use screws 12 and nut-plates 14 to join the two mating halves of missile sections together, as shown in FIGS. 1 and 2. The installation time and machining time required for this can be long. Each section must have the correct number of precision holes drilled and countersunk to accept the screw, and the mating section must have 3 holes per fastener drilled, one for the body of the fastener and two for the attachment of the nut plate. Installation of the nut plate rivets requires the mixing of a corrosion protection barrier, typically polysulfide.

The present invention employs a Nitinol ring clamp, which simply requires that both mating pieces have the same approximate groove feature machined into the end where the clamp will rest. The clamp sections and the Nitinol rings are positioned, and then, through the use of direct resistance heating for a maximum of about 10 seconds to fully seat the rings. The two sections are now joined via a Marmon clamp being retained by a Nitinol ring. Assembling the sections together provides a strong joint by nature of the Marmon clamp and it also reduces the assembly time process.

BRIEF SUMMARY OF THE INVENTION

The present invention is of a missile, a method of making a missile, and a clamp for making a missile, comprising: providing two sections of a missile; and joining the two sections with a clamp comprising: a plurality of pieces for engaging a circumference of the two sections, each of the pieces comprising at least two grooves extending substantially the length of the piece; and at least two Nitinol rings placed one in each of the at least two grooves. In the preferred embodiment, the Nitinol rings comprise rings of approximately 55% nickel by weight. The rings remain martensitic to approximately 45 degrees Celsius and recover to austenite at approximately 165 degrees Celsius. The clamp is preferably a Marmon clamp. The pieces comprise aluminum. The clamp preferably consists essentially of the pieces and the rings.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
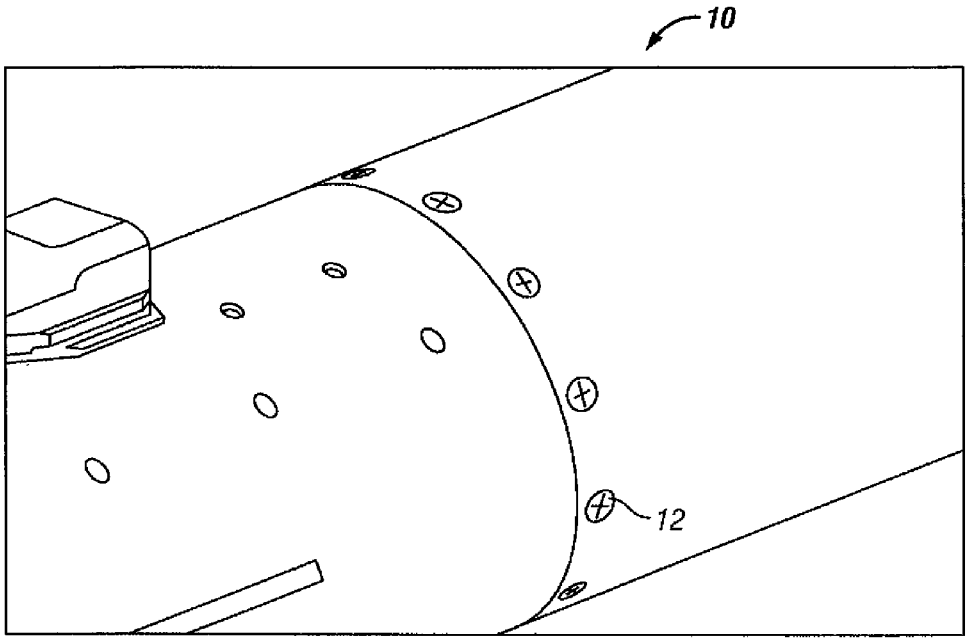
FIG. 1 (Prior Art)
FIG. 1 is an assembled view of missile sections joined according to the prior art.
Figure 2:
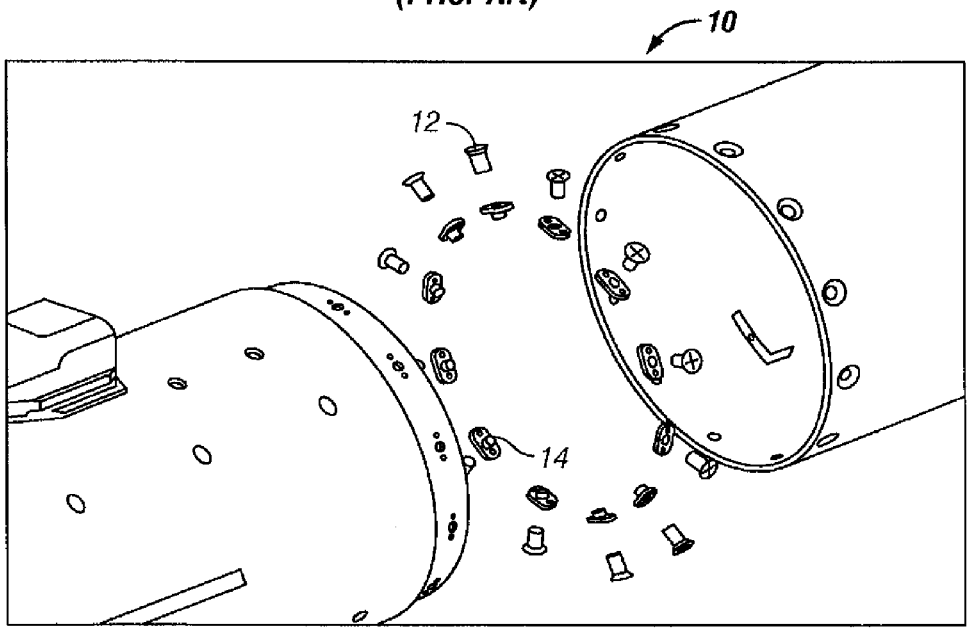
FIG. 2 (Prior Art)
FIG. 2 is an exploded disassembled view of missile sections joined according to the prior art.
Figure 3:
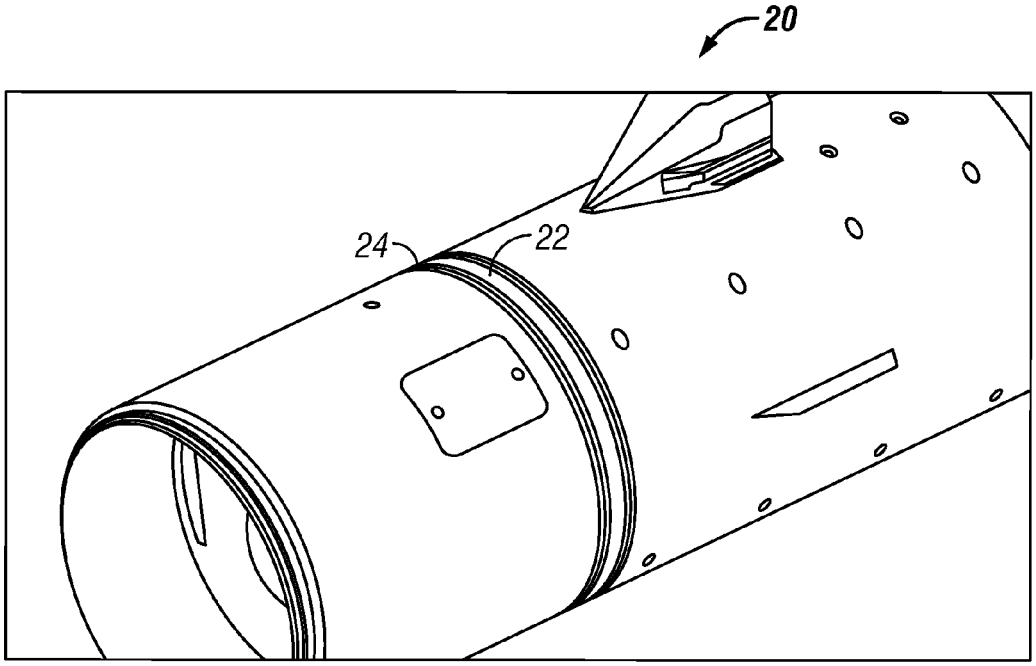
FIG. 3 is an assembled view of missile sections joined according to the invention.
Figure 4:
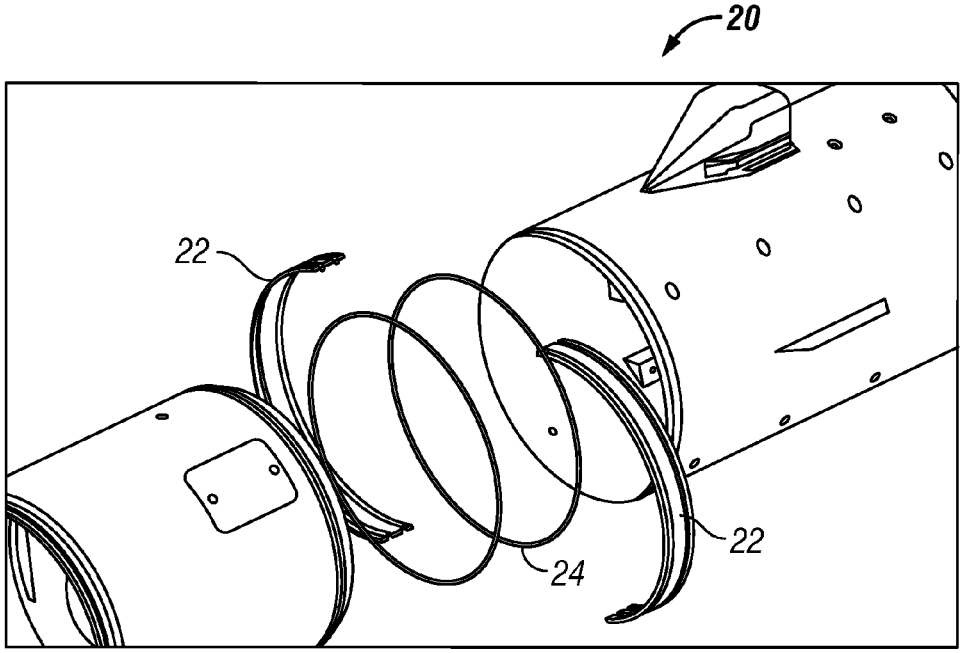
FIG. 4 is an exploded disassembled view of missile sections joined according to the invention.

Referring to FIGS. 3 and 4, the present invention 20 is of a method and apparatus to join two sections of a missile. At least two Nitinol rings 24 are employed together with a Marmon clamp 22. Both mating pieces of the missile have approximately the same groove feature (preferably one for each Nitinol ring) machined into the ends where the clamp will rest. The clamp sections and the Nitinol rings are positioned, and then, heating (preferably by direct resistance) for a maximum of approximately 10 seconds is employed to fully seat the rings. The two sections are now joined via a Marmon clamp being retained by a plurality of Nitinol rings. Of course, for design reasons only one side of the Marmon clamp could employ one or more Nitinol rings, while the other is connected by another method.

A "missile" as employed in the specification and claims is an object or weapon that is fired, thrown, dropped, or otherwise projected at a target, including a rocket that is simply targeted to a certain point in space. A "section" of a missile is a part of a missile having an approximately circular cross-section and which is connected after assembly to another section of the missile.

"Nitinol" as employed in the specification and claims refers to any Nickel Titanium (NiTi) alloy. Nitinol is a shape memory alloy also commonly referred to by its trade name, Nitinol. Above its transformation temperature, Nitinol is superelastic, able to withstand a large amount of deformation when a load is applied and return to its original shape when the load is removed. Below its transformation temperature, it displays the shape memory effect. When it is deformed it will remain in that shape until heated above its transformation temperature, at which time it will return to its original shape. Nitinol is preferably composed of approximately 55% Nickel by weight. Making small changes in the composition can change the transition temperature of the alloy significantly. For this reason, Nitinol may or may not be superelastic at room temperature. These unique properties and tailorability of Nitinol to be used in a wide range of temperatures makes it suitable for the present invention.

Nitinol alloys undergo a transformation from one crystal phase to another over a particular temperature range. Above this range, the material exists as austenite. Austenite has a rigid crystal structure. The shape of a component while in the austenite phase is termed the memory shape. The low temperature phase, martensite, is soft and can be deformed about 6% from its original shape without causing any permanent deformation. Once deformed, martensitic material will remain in this deformed shape indefinitely. When heated later, the material transforms to the high temperature phase and returns to its memory shape.

If a Nitinol part is constrained from fully recovering its memory shape, it will build up a repeatable clamping force. This force will be maintained as long as the material remains in the austenitic state. If cooled back to the martensitic state, the force exerted by the part will relax to zero. So, a shape memory fastener such as employed in the invention preferably has a reversion temperature to martensite that is below the minimum operating temperature of the installed fastener. In a preferred embodiment, a Nitinol alloy used with the invention remains martensitic to approximately 45° C., recovers to austenite and builds full clamping stress by approximately 165° C., maintains clamping stress on cooling to approximately −65° C., and does not become fully martensitic until cooled below approximately −120° C.

A "Marmon clamp" as used in the specification and claims is an approximately ring-shaped clamp comprising a plurality of segments, preferably equal length segments. A Marmon clamp is preferably used to couple the sections of a missile. A preferred material for a Marmon clamp for use with the invention is aluminum or an alloy thereof, preferably 6061 aluminum, and most preferably 6061T6 aluminum. The alloy composition of 6061 aluminum is approximately: Silicon minimum 0.4%, maximum 0.8% by weight; Iron no minimum, maximum 0.7%; Copper minimum 0.15%, maximum 0.40%; Manganese no minimum, maximum 0.15%; Magnesium minimum 0.8%, maximum 1.2%; Chromium minimum 0.04%, maximum 0.35%; Zinc no minimum, maximum 0.25%; Titanium no minimum, maximum 0.15%; Other elements no more than 0.05% each, 0.15% total; and remainder Aluminum. T6 temper 6061 has an ultimate tensile strength of at least approximately 42,000 psi (290 MPa) and yield strength of at least approximately 35,000 psi (241 MPa). In thicknesses of 0.250 inch (6.35 mm) or less, it has elongation of approximately 8% or more; in thicker sections, it has elongation of approximately 10%.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of making a missile, the method comprising the steps of:

providing two sections of a missile, each section of the missile forming an annular recess in an end portion of the each section; and joining the two sections with a clamp comprising:

a plurality of pieces sized to fit in the annular recesses of the two sections, each of the pieces comprising at least two grooves extending substantially the length of the piece and having an exterior surface that, when in a clamped position, is flush with an exterior surface of the two sections; and at least two Nitinol rings placed one in each of the at least two grooves, wherein the at least two grooves and the at least two Nitinol rings are sized such that, in the clamped position, exterior surfaces of the at least two Nitinol rings are flush with the exterior surfaces of the pieces.

2. The method of claim 1 wherein the Nitinol rings comprise rings of approximately 55% nickel by weight.

3. The method of claim 1 wherein the Nitinol rings comprise rings that remain martensitic to approximately 45 degrees Celsius.

4. The method of claim 3 wherein the Nitinol rings recover to austenite at approximately 165 degrees Celsius.

5. The method of claim 1 wherein the clamp is a Marmon clamp.

6. The method of claim 1 wherein the pieces comprise aluminum.

7. The method of claim 1 wherein the clamp consists essentially of the pieces and the rings.

8. A missile comprising:

two sections, each section forming an annular recess in an end portion of the each section; and a clamp joining said two sections, said clamp comprising:

a plurality of pieces sized to fit in the annular recesses of said two sections, each of said pieces comprising at least two grooves extending substantially the length of said piece and having an exterior surface that, when in a clamped position, is flush with an exterior surface of the two sections; and at least two Nitinol rings placed one in each of said at least two grooves, wherein the at least two grooves and the at least two Nitinol rings are sized such that, in the clamped position, exterior surfaces of the at least two Nitinol rings are flush with the exterior surfaces of the pieces.

9. The missile of claim 8 wherein said Nitinol rings comprise rings of approximately 55% nickel by weight.

10. The missile of claim 8 wherein said Nitinol rings comprise rings that remain martensitic to approximately 45 degrees Celsius.

11. The missile of claim 10 wherein said Nitinol rings recover to austenite at approximately 165 degrees Celsius.

12. The missile of claim 8 wherein said clamp is a Marmon clamp.

13. The missile of claim 8 wherein said pieces comprise aluminum.

14. The missile of claim 8 wherein said clamp consists essentially of said pieces and said rings.

* * * * *